US010405624B2

(12) United States Patent
Brouard

(10) Patent No.: US 10,405,624 B2
(45) Date of Patent: Sep. 10, 2019

(54) MODULAR CONFIGURABLE TOOL CARRIER

(71) Applicant: Veto Pro Pac, LLC, Norwalk, CT (US)

(72) Inventor: Roger Brouard, Norwalk, CT (US)

(73) Assignee: Veto Pro Pac, LLC, Norwalk, CT (US)

( * ) Notice: Subject to any disclaimer, the term of this patent is extended or adjusted under 35 U.S.C. 154(b) by 0 days.

(21) Appl. No.: 15/585,040

(22) Filed: May 2, 2017

(65) Prior Publication Data

US 2018/0319541 A1 Nov. 8, 2018

(51) Int. Cl.

| | |
|---|---|
| ***B65D 85/28*** | (2006.01) |
| ***A45C 13/02*** | (2006.01) |
| ***B25H 3/00*** | (2006.01) |
| ***A45C 11/00*** | (2006.01) |
| ***A45C 5/00*** | (2006.01) |
| ***A45C 5/02*** | (2006.01) |

(52) U.S. Cl.

CPC ..... *A45C 13/02* (2013.01); *A45C 5/00* (2013.01); *A45C 5/02* (2013.01); *A45C 11/00* (2013.01); *B25H 3/00* (2013.01)

(58) Field of Classification Search

CPC ..... B65D 25/06; B65D 25/04; A45C 11/00; A45C 13/02; A45C 2013/026; A45C 7/005; B25H 3/021

USPC ..... 206/372, 349, 320, 561; 220/23.83, 528

See application file for complete search history.

(56) References Cited

U.S. PATENT DOCUMENTS

| | | | | |
|---|---|---|---|---|
| 5,454,478 | A * | 10/1995 | Everson | A45C 13/02 220/23.83 |
| D426,384 | S | 6/2000 | Brouard | |
| 6,126,003 | A | 10/2000 | Brouard | |
| D487,345 | S | 3/2004 | Brouard | |
| D490,245 | S | 5/2004 | Brouard | |
| 6,915,902 | B2 | 7/2005 | Brouard | |
| D613,507 | S | 4/2010 | Brouard | |
| 8,403,141 | B2 * | 3/2013 | Williams | A45C 13/02 190/124 |
| 8,967,379 | B2 * | 3/2015 | Kinskey | B25H 3/023 150/113 |
| D739,654 | S | 9/2015 | Brouard | |
| 9,345,301 | B2 | 5/2016 | Brouard et al. | |
| 9,566,704 | B1 * | 2/2017 | Stoikos | B25H 3/02 |
| 2008/0073361 | A1 | 3/2008 | Brouard | |
| 2008/0202962 | A1 | 8/2008 | Brouard | |
| 2008/0230416 | A1 | 9/2008 | Brouard | |

(Continued)

*Primary Examiner* — Rafael A Ortiz

(74) *Attorney, Agent, or Firm* — Alix, Yale & Ristas, LLP

(57) ABSTRACT

The carrier includes a base having a bottom surface that extends upward to a peripheral edge. A stiff but flexible bag body having a pair of opposed sides and a pair of opposed ends is fastened to the peripheral edge and projects upward to a rim. A removable handle assembly extends across the carrier and is fastened to the ends of the carrier between a stepped bracket and a D-ring plate. The body defines an interior of the carrier. A divisible receptacle defining a cavity extends between the ends of the carrier and includes a plurality of guides protruding into the cavity. A moveable partition insert defining a chamber and including a plurality of tracks compatible with the guides is received by the receptacle. The insert can be placed into more than one position within the receptacle, thereby creating customizable and separate compartments within the receptacle.

20 Claims, 8 Drawing Sheets

(56) References Cited

U.S. PATENT DOCUMENTS

| | | | | |
|---|---|---|---|---|
| 2015/0201722 | A1 | 7/2015 | Brouard | |
| 2017/0137177 | A1* | 5/2017 | Prezecki, II ..... | B65D 25/06 |

* cited by examiner

MODULAR CONFIGURABLE TOOL CARRIER

BACKGROUND

Many tasks, hobbies, and occupations benefit from a carrying device capable of transporting, organizing, and protecting a wide variety of small items. Devices of this type include buckets, bags, boxes, storage bins, and hard and soft toolboxes. The uses for this type of carrying device include, but are not limited to, outdoor enthusiasts, construction, fishing, mining, and agriculture.

For many users in the aforementioned fields, it is preferred that the carrying device be rigid. Rigidity supports the contents of the carrying device and protects the contents from the surrounding elements. It is also preferred that the carrying device provide easy access to the items carried, such that when a specific item is needed it can be located and removed efficiently.

To maintain easy access, the carrying device typically includes an organizational feature so that the contents of the carrying device are in a predetermined position within the carrying device when needed. Prior art carrying devices may incorporate these features by sacrificing space. Also, prior art carrying devices usually do not enable a user to customize the space within the carrying device. There is a need in the art for a structured carrying device having accessibility to the items carried, while also allowing the user to customize the organization of the carrying device without compromising valuable space therein.

SUMMARY OF THE INVENTION

The disclosed embodiment of an open top tool carrier (hereinafter, "carrier") looks and functions like a bag, protects and stands up like a rigid container, and allows for space within the carrier to be customized to the needs of a user. The disclosed carrier is constructed from components selected and arranged to provide the carrier with added stiffness that will permit the carrier to stand upright, stay open, and allow the user to configure custom compartments within the carrier.

The carrier includes a tub-like base having a bottom surface and sidewalls that extend upward to a peripheral edge. A stiff but flexible bag body having a pair of opposed sides and a pair of opposed ends is fastened to the peripheral edge and projects upward to a rim. A removable handle assembly extends across the carrier and is fastened to the ends of the carrier between a stepped bracket and a D-ring plate.

The body includes front and rear assemblies, each assembly having substantially a substantially identical shape. The assemblies of the bag body include PE board sandwiched between an interior and exterior fabric. The assemblies are bent to connect to each other at the ends to form a stiff, self-supporting 3-D body. The upper edge of each assembly is coupled to the rim.

The body defines an interior of the carrier. A divisible receptacle defining a cavity extends between the ends of the carrier and includes a plurality of guides protruding into the cavity. A moveable partition insert defining a chamber and including a plurality of tracks compatible with the guides is received by the receptacle. The insert can be placed into five different positions within the receptacle, thereby creating three customizable and separate compartments within the receptacle.

BRIEF DESCRIPTION OF THE DRAWINGS

Aspects of the preferred embodiment will be described in reference to the drawings, where like numerals reflect like elements.

DETAILED DESCRIPTION

Figure 1:
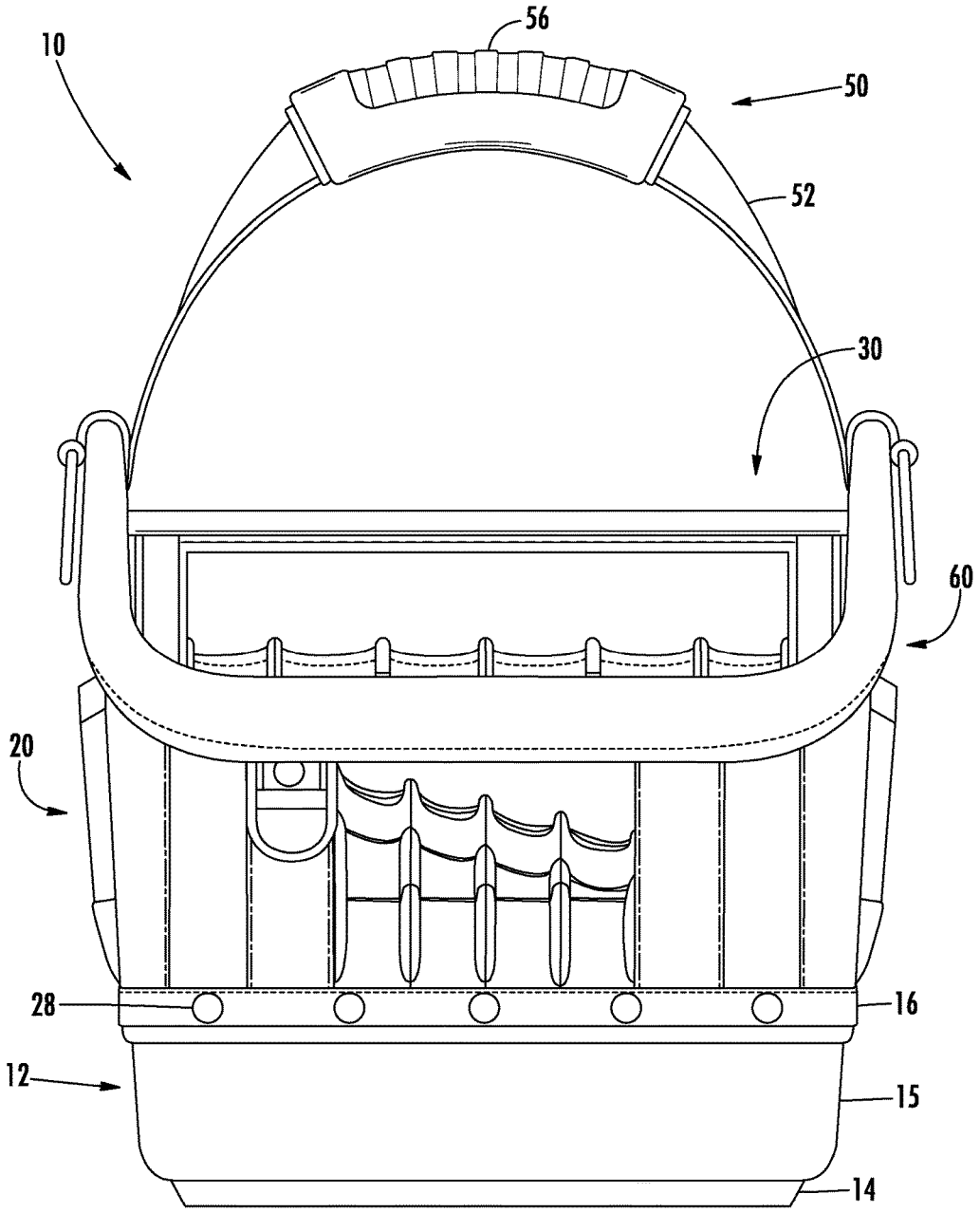
FIG. 1 is a front view of an embodiment of a carrier.

An embodiment of a carrier according to aspects of the disclosure will now be described with reference to FIGS. 1-8*b*, wherein like numerals represent like parts. The carrier will generally be referred to by the reference numeral 10. Various materials, methods of construction, methods of manufacture, and methods of fastening will be discussed in the context of the disclosed embodiment. Those skilled in the art will recognize known substitutes for the materials, manufacturing methods, and fastening methods, all of which are contemplated as compatible with the disclosed embodiment and are intended to be encompassed by the appended claims.

As shown in FIGS. 1-4, the disclosed embodiment of the carrier 10 includes a tub-like base 12, a bag body 20, a divisible receptacle 30, a moveable partition insert 40, and a handle assembly 50. The base 12 includes a bottom surface 14 and sidewalls 15 that project upward to a peripheral lip 16 to form a concave, tub-like foundation for the carrier 10. In the disclosed embodiment, the base 12 is constructed of a molded or thermoformed plastic.

As shown in FIGS. 1-3*b* of the disclosed embodiment, the body 20 defines an interior 22 and is generally symmetrical, including a pair of substantially identical opposed ends 24 and a pair of substantially identical opposed sides 26. The ends 24 of the body 20 extend higher than the sides 26 of the body 20. A symmetrical configuration is not required and the body 20 may have one or more asymmetrical features depending upon the intended use.

Figure 5:
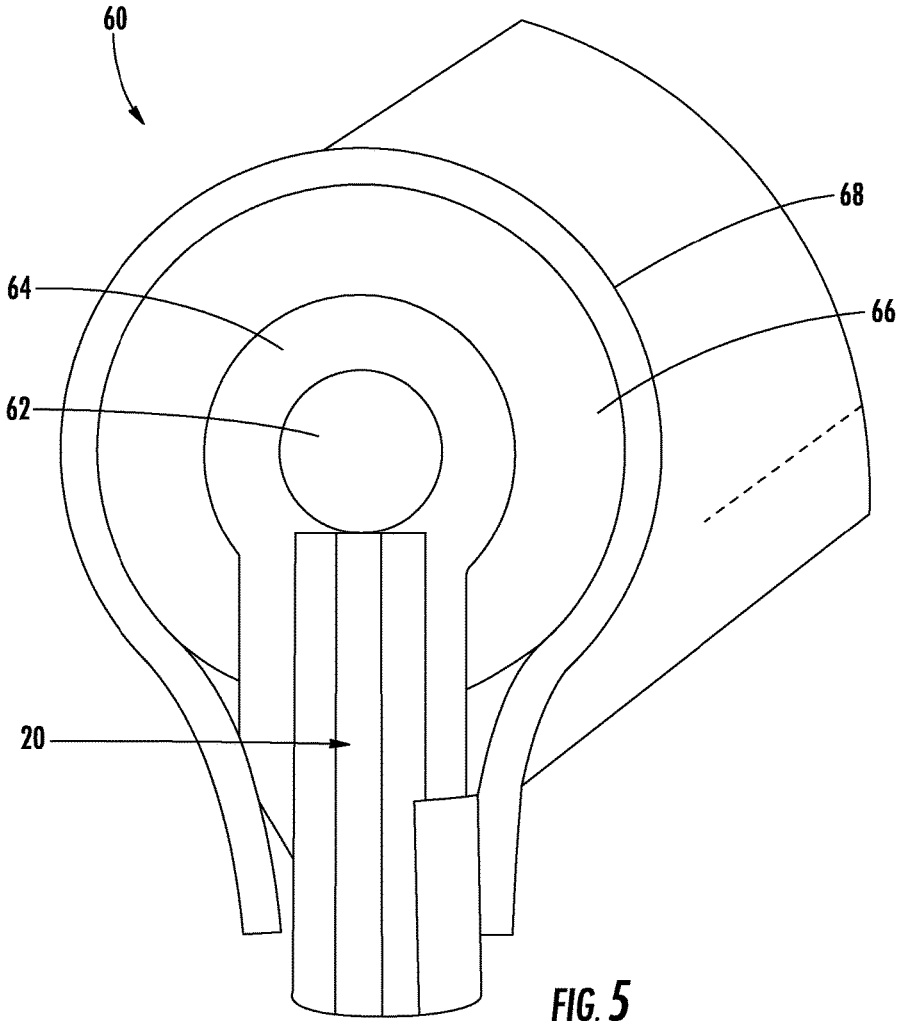
FIG. 5 is a side cross-sectional view of a rim of the carrier of FIG. 1.

The carrier 10 is constructed of various materials such as nylon, leather, polypropylene webbing and PE board. The body 20 includes substantially identical front and rear assemblies. Each assembly of the body 20 is comprised of a panel of PE board sandwiched between a fabric interior and a fabric exterior. The assemblies are bent to connect to each other at the ends 24 to form a stiff, self-supporting 3-D body 20. A flap of nylon is folded over the peripheral lip 16 of the base 12 and a lower edge of the body 20 is fastened to the peripheral lip 16 of the base 12 with a plurality of stainless steel rivets 28. The body 20 projects upward and is coupled to a stiff but flexible rim 60. As shown in FIG. 5, the rim 60 may include a fiber glass rod core 62 semi-encircled by a layer of extruded soft vinyl 64, a layer of foam sheet 66, and an exterior layer 68 of leather. The fiber glass rod core 62 may be omitted from the rim 60. An upper edge of the body 20 projects into an underside of the rim 60. The exterior layer 68 of the rim 60 is stitched to the body 20. The ends 24 of the body 20 may include pockets attached to the exterior. A clip for holding a tape measure may also be attached to the exterior of one of the ends 24.

Figure 3A:
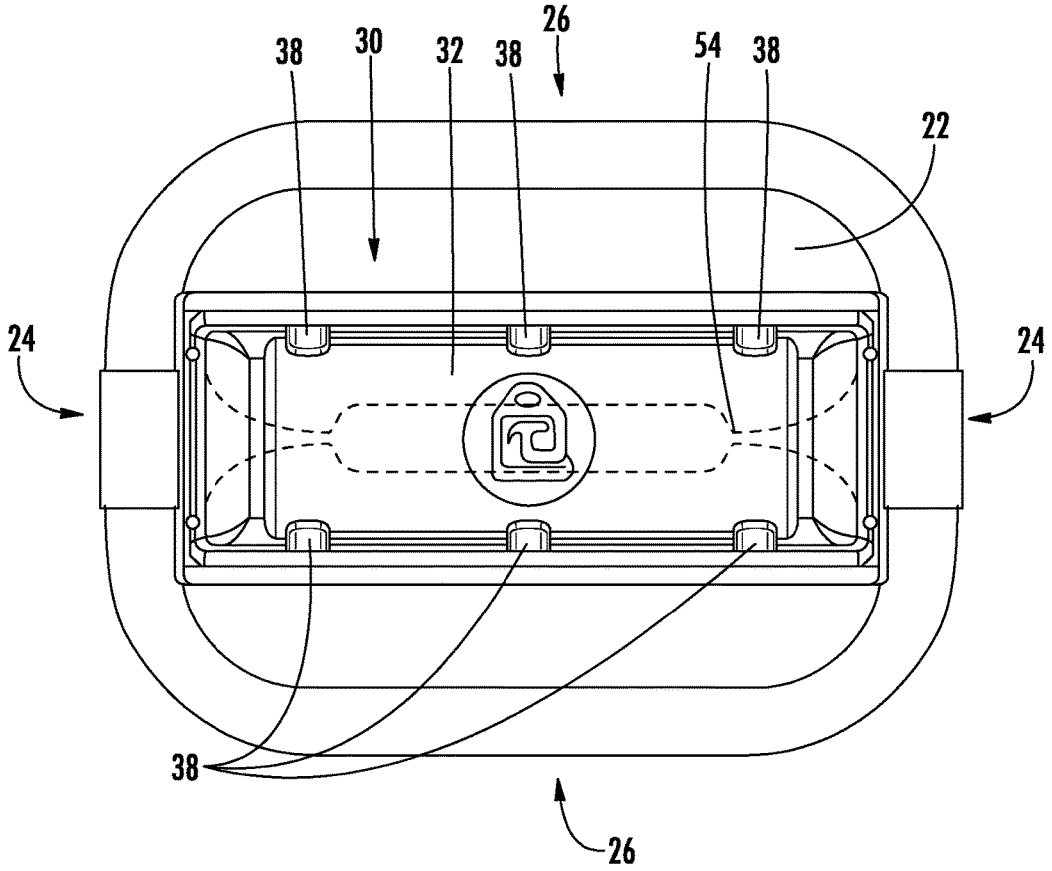
FIG. 3*a* is a top view of the carrier of FIG. 1.
Figure 3B:
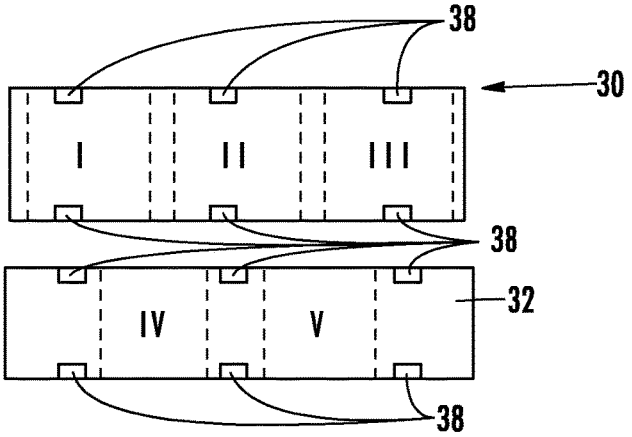
FIG. 3*b* is a top view of the divisible receptacle and moveable partition insert of FIG. 1.
Figure 4:
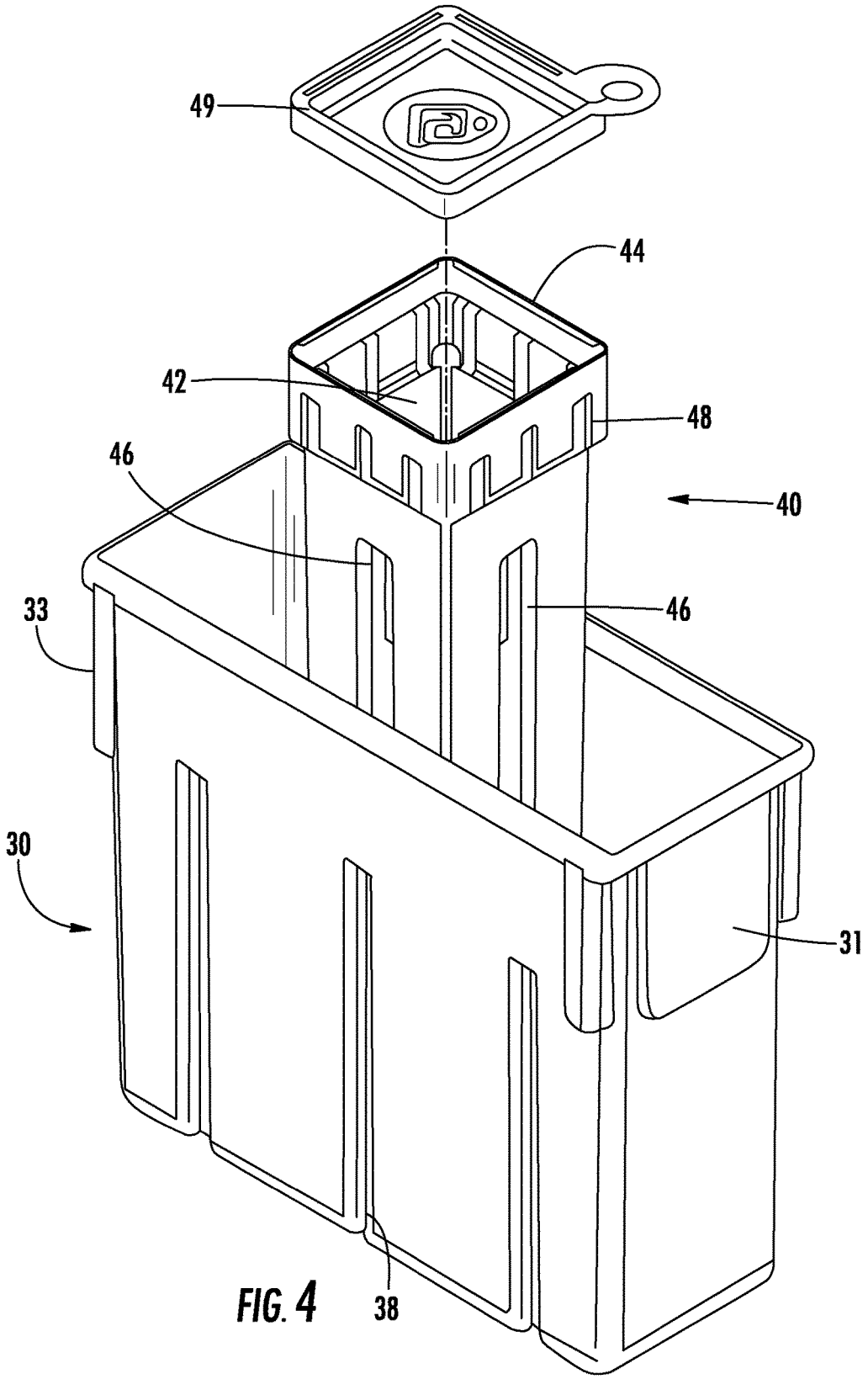
FIG. 4 is an exploded perspective view of a divisible receptacle, a moveable partition insert, and a lid of the carrier of FIG. 1.

As shown in FIGS. 3*a*-4 of the disclosed embodiment, the receptacle 30 longitudinally spans the center of the carrier 10 and is secured to each of the ends 24. The receptacle 30 extends perpendicularly from the bottom surface 14 of the base 12 to a position above the sides 26 and below the ends 24 of the body 20. The receptacle 30 defines a cavity 32 for receiving the insert 40. A plurality of interior guides 38 protrude into the cavity 32 from walls of the receptacle 30 to align the insert 40. Each guide 38 faces another guide 38 on an opposing wall. The guides 38 are perpendicular to the bottom surface 14 of the base 12 and extend more than halfway from a bottom to a top of the receptacle 30. In the disclosed embodiment, there are three pairs of guides 38.

Figure 6A:
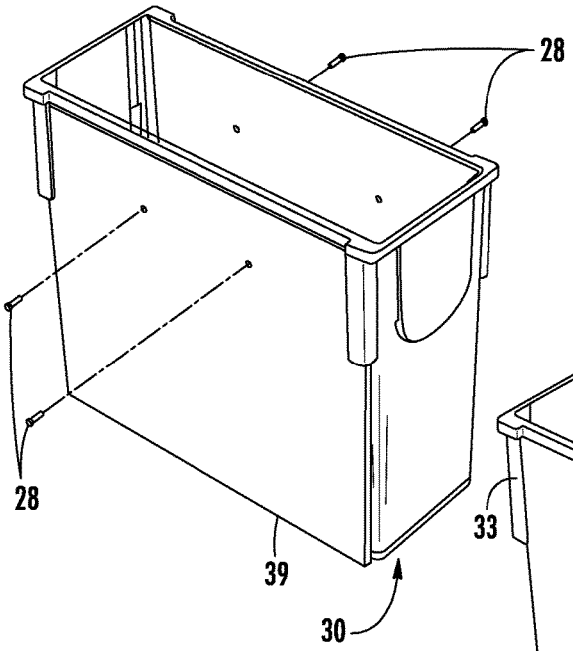
FIG. 6*a* is a perspective view of a pocket panel and the receptacle of the carrier of FIG. 1.
Figure 6B:
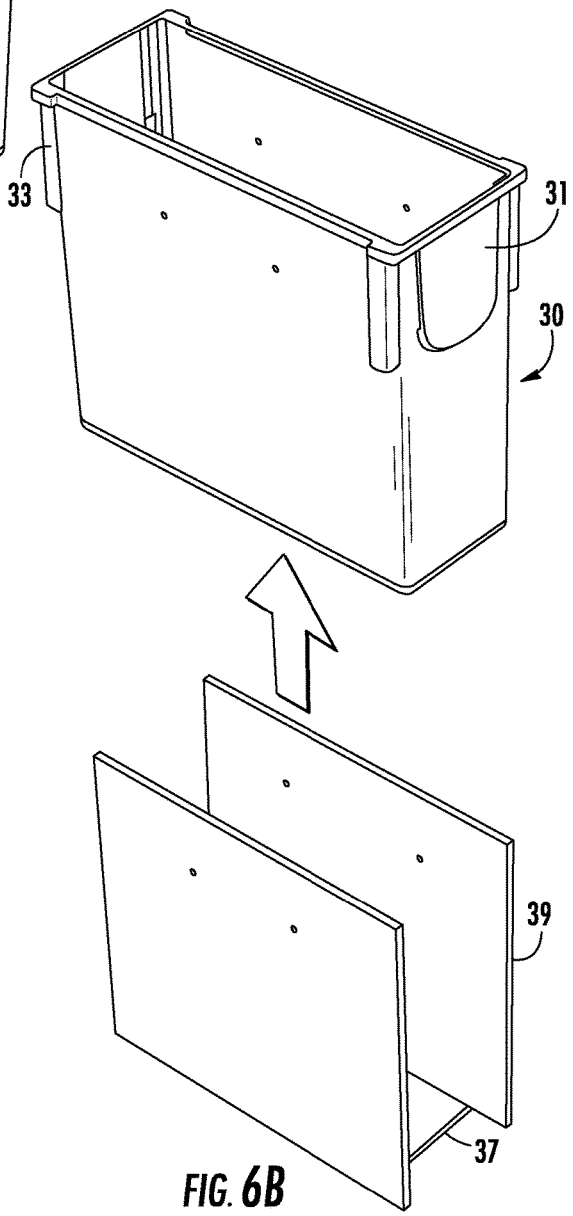
FIG. 6*b* is a perspective exploded view of a pocket panel and the receptacle of FIG. 1.

As shown in FIGS. 6*a* and 6*b*, a pair of pocket panels 39 for receiving tools and other small items is secured to exterior walls of the receptacle 30. Each pocket panel 39 includes a layer of fabric pockets facing the sides 26 of the body 20. The fabric pockets are affixed to an inner layer of PE board. An upper edge of the pocket panels 39 is received in a slot 33. The slot 33 extends vertically along each exterior corner of the receptacle 30 and horizontally along the periphery of the top of the receptacle 30. The slot 33 reinforces the attachment of the pocket panels 39 to the receptacle 30 and deflects sharp edges of the tools inserted in the pockets. The pocket panels 39 are connected to one another by a fabric extension 37 that extends beneath the receptacle 30. The pocket panels 39 are secured to the receptacle 30 with rivets 28.

The insert 40 is received in the cavity 32 of the receptacle 30 to divide the receptacle 30 into compartments. The insert 40 may be the same height as the receptacle 30. The insert 40 defines a chamber 42, which extends from a bottom (not shown) of the insert 40 to an opening at a top of the insert 40. The insert 40 includes four walls, each defining an exterior track 46 complimentary to the guides 38 protruding into the cavity 12 of the receptacle 30. The insert 40 also defines a series of depressions 48 adjacent the top 44 for accommodating the rivets 28 used to secure the tool pocket panels 39 to the receptacle 30. The insert 40 may also be removed completely from the receptacle 30 and used to dispense small parts, such as screws and nails, conveniently in an area remote from the carrier 10.

As shown in FIG. 3*b*, the insert 40 can be placed in multiple positions within the receptacle 30 such that the receptacle 30 is partitioned into different configurations. In the disclosed embodiment, the insert 40 can be placed in five different positions, shown by reference numerals I-V. In each position I-V, the insert 40 divides the receptacle 30 into three separate compartments. In the disclosed embodiment, three inserts 40 may be received by the receptacle 30. In positions I-III, the insert 40 is received by the receptacle 30 and the guides 38 on each opposing wall of the receptacle 30 mate with the tracks 46 on each opposing wall of the insert 40. In positions IV and V, the insert 40 is received by the receptacle 30 and the insert 40 is situated between pairs of opposing guides 38. A lid 49 constructed of thermoplastic rubber, or other compatible materials, covers the opening at the top 44 of the insert 40. The lid 49 may also include a depression and a magnet for attracting and holding loose ferromagnetic items such as screws.

Figure 2:
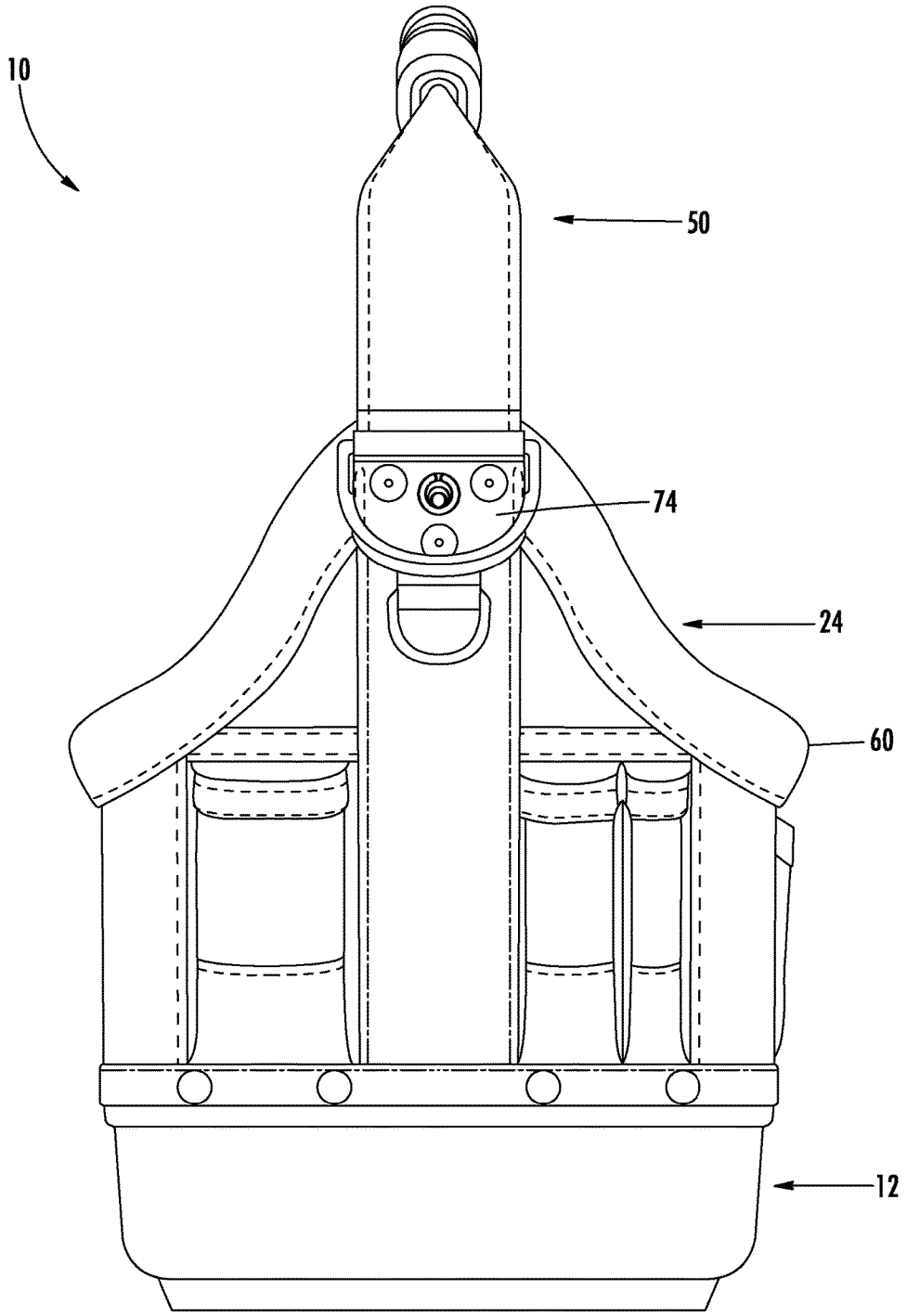
FIG. 2 is an end view of the carrier of FIG. 1.
Figure 7:
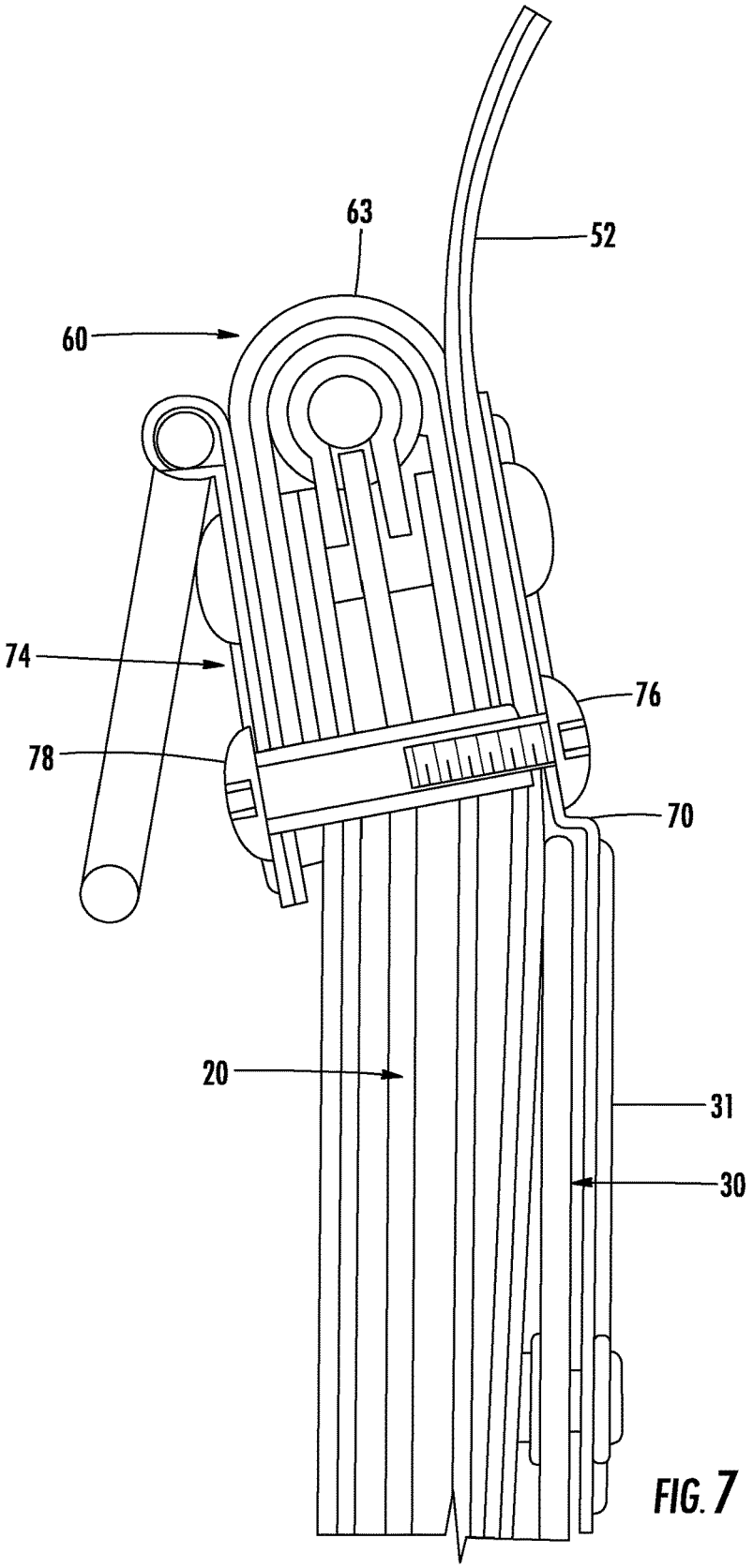
FIG. 7 is a side cross-sectional view of the end of FIG. 2.
Figure 8A:
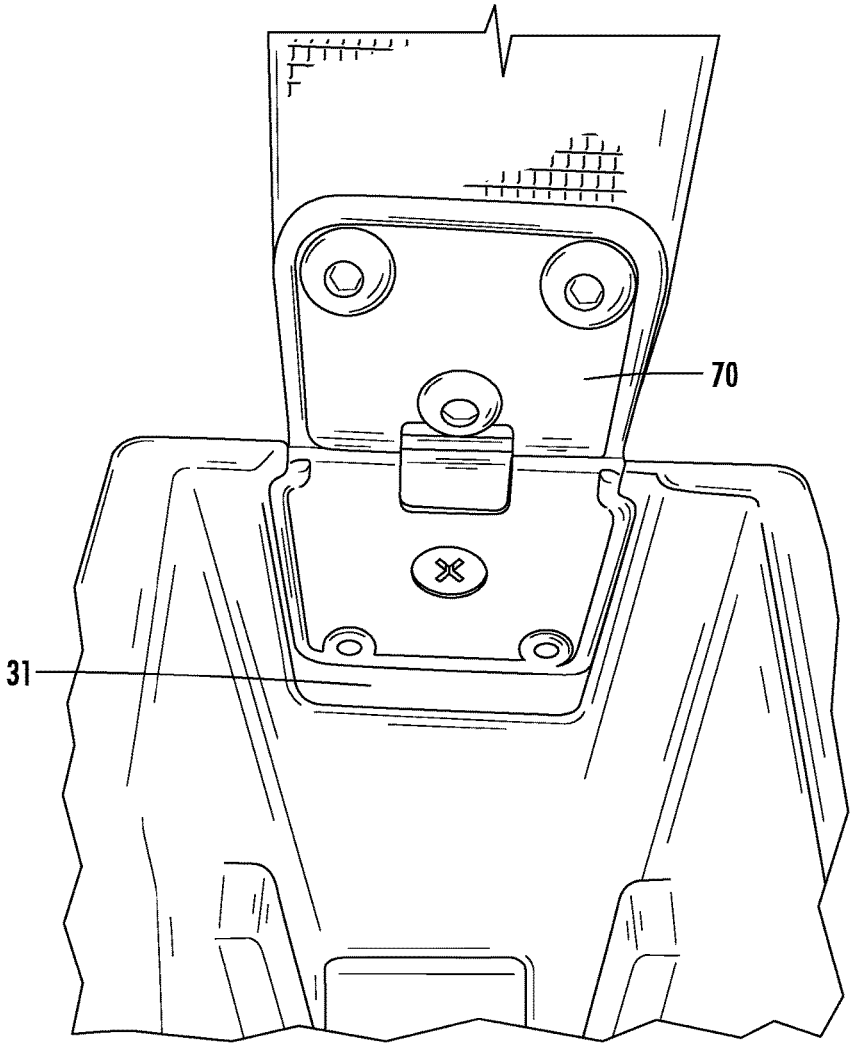
FIG. 8*a* is a perspective view of a stepped bracket of the carrier of FIG. 1.
Figure 8B:
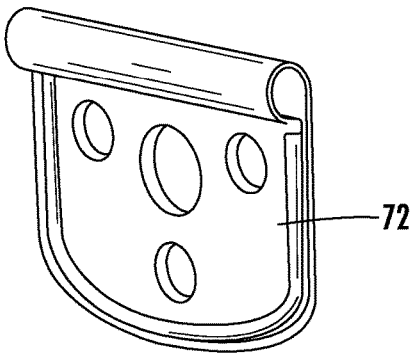
FIG. 8*b* is a perspective view of a D-ring plate of the carrier of FIG. 1.

As shown in FIGS. 1-3*a* of the disclosed embodiment, the handle assembly 50 projects above the body 20 and is secured to each of the ends 24. The handle assembly 50 includes a strap 52 extending through an overmolded grip 56 at a center above the body 20. As, shown in FIG. 7, each side of the strap 52 is constructed of a strip of PE board sandwiched between two strips of webbing. As shown in FIGS. 2 and 3*a*, each strip of PE board narrows to a point adjacent the overmolded grip 56. The webbing is folded over at the center and encased by a polypropylene shell and the overmolded grip 56. As shown in FIGS. 7-8*b*, each side of the strap 52 extends down between the ends 24 of the body 20 and a stepped bracket 70 and between the body 20 and the receptacle 30. The stepped bracket 70 fits over the top of the receptacle 30 into the cavity 32 and is received by an interior recess 31 in the walls of the receptacle 30. As shown in FIG. 7, each side of the strap 52 and the body 20 are sandwiched between and held together by the stepped bracket 70 and a D-ring plate 74. An additional strip of leather may also be folded over the rim 60 at the ends 24 and sandwiched between body 20 and the strap 52 and the body 20 and the D-ring plate 74. A truss head 76 and a barrel bolt 78, or other compatible fasteners, are inserted through the stepped bracket 70, the strap 52, the body 20, the strip of leather 63 and the D-ring plate 74 and fastened together, establishing a tight engagement of the handle assembly 50 and each of the ends 24.

The handle assembly 50 extends down to a position above the base 12, such that it is not riveted to the base 12 and can be removed by unfastening the truss head 76 and the barrel bolt 78.

What is claimed:

1. An open top tool carrier comprising:

a base having a flat bottom surface;

a bag body projecting from said base to a rim and defining an interior, said body having opposing ends and opposing sides;

a handle assembly extending between said ends;

a divisible receptacle having end walls fastened to said bag body and longitudinal walls extending between said end walls, said end walls and said longitudinal walls defining a cavity, said receptacle having an inside surface and a plurality of guides spaced apart from each other along said longitudinal walls and opposing each other on said inside surface;

a moveable partition insert including a bottom and a plurality of walls having tracks for mating with said guides, said plurality of walls defining a chamber, said insert received by said receptacle and said plurality of walls separating said chamber from said cavity, wherein said insert is mated with said receptacle in different positions within said receptacle, said positions including a first position wherein said tracks are mated with said guides and a second position wherein said tracks are not mated with said guides and said plurality of walls of said insert are positioned between said guides, each of said positions causing said receptacle to be segmented.

2. The open top tool carrier of claim 1, wherein the receptacle is perpendicular to said base and includes at least one interior guide.

3. The open top tool carrier of claim 2, wherein the insert includes at least one exterior track complimentary to the at least one guide of said receptacle.

4. The open top tool carrier of claim 1, wherein the insert includes a lid having a magnet.

5. The open top tool carrier of claim 1, wherein the handle assembly is secured to the ends of said body, the handle assembly and each of said ends are sandwiched between a bracket and a plate, and the handle assembly, the ends, the bracket and the plate receive a fastener.

6. The open top tool carrier of claim 1, wherein the handle is removable.

7. The open top tool carrier of claim 1, wherein the receptacle defines an interior recess, the recess receiving a stepped bracket and the bracket is fastened to said body.

8. The open top tool carrier of claim 1, wherein the insert can be placed into five different positions within the receptacle.

9. The open top tool carrier of claim 8, wherein the insert creates three segments within the receptacle.

10. The open top tool carrier of claim 1, wherein the body includes a layer of PE board sandwiched between two layers of fabric and the body is coupled to the rim.

11. A method of constructing a carrier, said method comprising:

providing a base having a bottom surface and a body projecting from said base to a rim and defining an interior;

providing a divisible receptacle having end walls fastened to said body and longitudinal walls extending between said end walls, said end walls and said longitudinal walls defining a cavity, said receptacle having an inside surface and a plurality of guides spaced apart from each other along said longitudinal walls and opposing each other on said inside surface;

providing a moveable partition insert receivable by said receptacle, said insert including a bottom and a plurality of walls having tracks for mating with said guides, said plurality of walls defining a chamber;

providing a handle assembly extending above and across the body;

mating said receptacle and said insert, wherein said step of mating said receptacle and said insert includes mating said receptacle and said insert in more than one position within the receptacle, said positions including a first position wherein said tracks are mated with said guides and a second position wherein said tracks are not mated with said guides and said plurality of walls of said insert are positioned between said guides, each of said positions causing the receptacle to be segmented.

12. The method of constructing a carrier of claim 11, wherein the step of providing said insert includes said insert having at least one track.

13. The method of constructing a carrier of claim 12, wherein the step of mating the receptacle and the insert includes aligning a pair of opposing guides with two tracks.

14. The method of constructing a carrier of claim 12, wherein the step of mating the receptacle and the insert includes aligning said insert between two pairs of adjacent guides.

15. The method of constructing a carrier of claim 11, wherein the step of providing a divisible receptacle includes the receptacle defining an interior recess, the recess receiving a stepped bracket and the bracket fastening to said body.

16. The method of constructing a carrier of 12, wherein the step of providing a handle assembly includes said handle assembly being removable.

17. A divisible receptacle for use in a carrier, the receptacle comprising:

end walls and longitudinal walls extending between said end walls, said end walls and said longitudinal walls defining a cavity, said receptacle having an inside surface and a plurality of guides spaced apart from each other along said longitudinal walls and opposing each other on said inside surface, said longitudinal walls including an exterior and a pocket panel affixed to said exterior;

a moveable partition insert receivable by said receptacle, said insert including a bottom and a plurality of walls having tracks for mating with said guides, said plurality of walls defining a chamber between said tracks;

wherein, the insert is mated with said receptacle in more than one position within the receptacle, said positions including a first position wherein said tracks are mated with said guides and a second position wherein said tracks are not mated with said guides and said plurality of walls of said insert are positioned between said guides, each of said positions causing the receptacle to be segmented.

18. The receptacle of claim 17, wherein the guides of the receptacle extend from a bottom to more than halfway to a top of the receptacle.

19. The receptacle of claim 17, wherein the receptacle and the insert are the same height.

20. The open top tool carrier of claim 1, wherein the distance between the guides is substantially equal to a width of the insert.

* * * * *